US005306335A

United States Patent [19]

Senda et al.

[11] Patent Number: 5,306,335

[45] Date of Patent: Apr. 26, 1994

[54] ELECTROLESS BISMUTH PLATING BATH

[75] Inventors: Atsuo Senda; Takuji Nakagawa; Yoshihiko Takano, all of Kyoto, Japan

[73] Assignee: Murata Manufacturing Co., Ltd., Japan

[21] Appl. No.: 13,701

[22] Filed: Feb. 4, 1993

[30] Foreign Application Priority Data

Feb. 5, 1992 [JP] Japan ..... 4-019751

[51] Int. Cl.[5] ..... C23C 18/16

[52] U.S. Cl. ..... 106/1.22; 106/1.25

[58] Field of Search ..... 106/1.22, 1.25

[56] References Cited

U.S. PATENT DOCUMENTS 3,323,938 6/1967 Vaught ..... 106/1.22

3,947,610 3/1976 Bodmer et al. ..... 106/33

FOREIGN PATENT DOCUMENTS 637457 12/1978 U.S.S.R. ..... 106/1.25

*Primary Examiner*—Helene Klemanski

*Attorney, Agent, or Firm*—Ostrolenk, Faber, Gerb & Soffen

[57] ABSTRACT

In an electroless plating bath containing bismuth trichloride, a reducing agent and complexing agents, stannous chloride is employed as the reducing agent to enable electroless plating of bismuth, which has generally been regarded as impossible. A preferable composition of the plating bath is 0.08M of bismuth trichloride, 0.34M of sodium citrate, 0.08M of EDTA, 0.20M of nitrilotriacetic acid, and 0.04M of stannous chloride. In plating treatment, the plating bath preferably has a temperature of 60° C. and a pH value of 8.6 to 8.8.

11 Claims, 7 Drawing Sheets

ELECTROLESS BISMUTH PLATING BATH

BACKGROUND OF THE INVENTION

1. Field of the Invention

The present invention relates to a plating bath which is employed for electroless bismuth plating.

2. Description of the Background Art

Electroless plating is carried out through parallel reaction of cathodic deposition of a metal and anodic oxidation of a reducing agent. In general, the reducing agent is prepared from sodium hypophosphite, formalin, sodium borohydride or dimethylamine borane to put electroless plating into practice with a metal such as nickel or cobalt.

In order to cause a plating reaction in such electroless plating, the reversible potential of the deposition metal electrode must be "nobler" than the oxidation-reduction potential of the reducing agent in terms of equilibrium. In this point, bismuth is conceivably capable of plating deposition since the same has a sufficiently "nobler" reversible potential of +0.314 V (vs. N. H. E.) than that of −0.236 V or −0.287 V (vs. N. H. E.) of nickel or cobalt, which is an element capable of carrying out electroless plating with the aforementioned reducing agent of sodium hypophosphite or the like.

However, the possibility of electroless plating is remarkably influenced by the anodic oxidation velocity of the reducing agent, which extremely depends on the electrode metal. This is because the deposition metal, which gradually covers the basis material, itself must have sufficient catalytic activity with respect to oxidation of the reducing agent in order to attain stationary progress of the plating. While nickel and cobalt are transition elements, bismuth is a typical element. It is known that a typical element has low catalytic activity or acts as a catalyst poison due to the state of its electron configuration. Thus, it has heretofore been regarded impossible to form a bismuth film by electroless plating (refer to "Nikkei Hi-Tech Information" Jun. 2, 1986, pp. 24 to 28, for example).

SUMMARY OF THE INVENTION

Accordingly, an object of the present invention is to provide an electroless bismuth plating bath for enabling electroless plating with bismuth, which has been impossible to deposit in conventional electroless plating.

The electroless bismuth plating bath according to the present invention contains a trivalent salt of bismuth, a bivalent water soluble compound of tin serving as a reducing agent, and a complexing agent.

Among these components, the trivalent salt of bismuth is typically prepared from $BiCl_3$, and the bivalent water soluble compound of tin serving as a reducing agent is typically prepared from stannous chloride ($SnCl_2$).

The stannous chloride for serving as a reducing agent is now described.

Stannous chloride is employed as a reducing agent in oxidation-reduction titration. In addition to the oxidation-reduction titration, reaction with stannous chloride serving as a reducing agent is already employed for pretreatment of a target of plating in electroless plating. In two-part pretreatment with palladium chloride/tin chloride solutions, for example, nucleation of metal palladium is performed through the following reaction:

$$Pd^{2+}+Sn^{2+}\rightarrow Pd^{o}+Sn^{4+}$$

When this reaction is applied to electroless plating deposition of bismuth, reducing deposition of bismuth is conceivably enabled by the following reaction:

$$2Bi^{3+}+3Sn^{2+}\rightarrow 2Bi^{o}+3Sn^{4+}$$

The possibility of this reaction is also supported by the deposition potential of bismuth and the oxidation-reduction potential of $Sn^{2+}$.

Thus, according to the present invention, employment of a bivalent water soluble compound of tin such as stannous chloride enables electroless plating of bismuth, which has been regarded as impossible. Therefore, it is possible to deposit an electroless bismuth plating film even on a non-conductor, so far as the same is activated. Further, thick plating is also enabled by autocatalytic reaction of the bismuth film.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
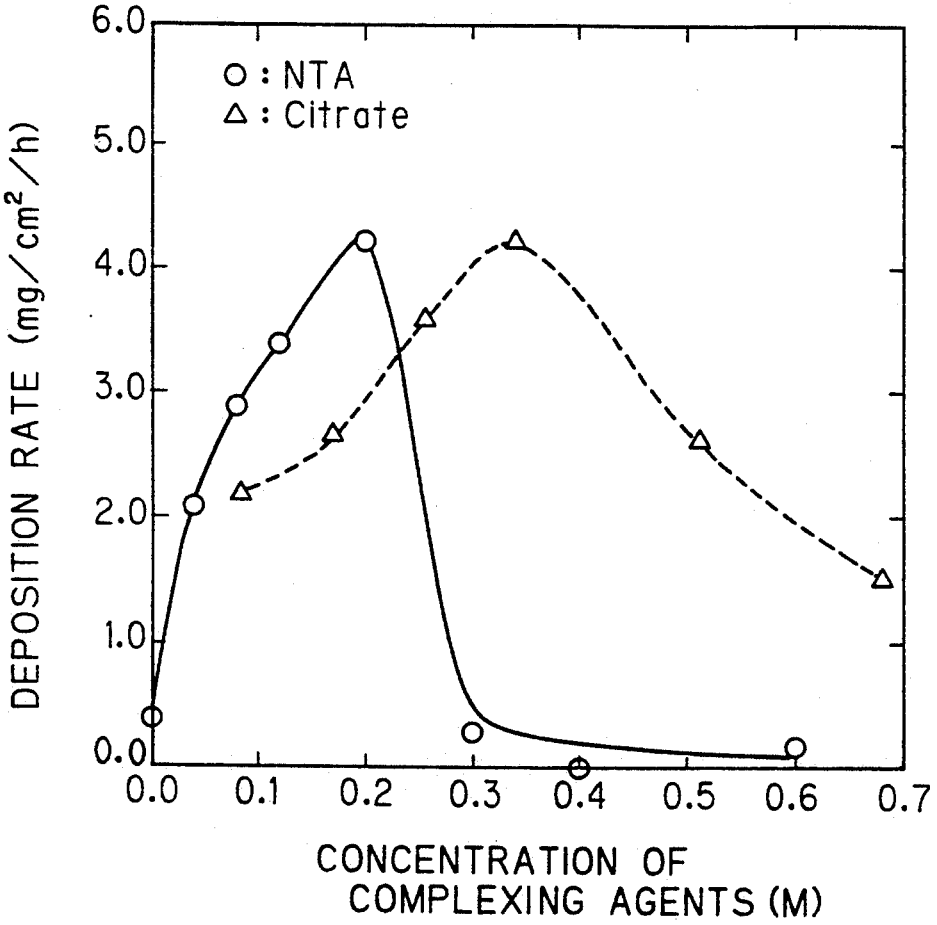
FIG. 1 illustrates influences exerted on the deposition rate by concentration of complexing agents.

An experiment which was made in accordance with the present invention is now described.

1. Method of Experiment 1.1 Formation of Plating Bath and Plating Method

Table 1 shows a basic bath composition and basic plating conditions. All chemicals employed in this experiment were prepared from special reagents (by Nacalai Tesque, Inc.).

TABLE 1

| Composition | Concentration (M) |
|---|---|
| $C_6H_5O_7Na_3.2H_2O$ | 0.34 |
| $C_{10}H_{14}Na_2O_8.2H_2O$ | 0.08 |
| $N(CH_2COOH)_3$ | 0.20 |
| $BiCl_3$ | 0.08 |
| $SnCl_2.2H_2O$ | 0.04 |
| pH(adjusted with 28% $NH_4OH$) | 8.6–8.8 |
| Temperature | 60° C. |

First, EDTA.2Na, citrate.3Na and nitrilotriacetic acid (NTA) were dissolved in hot water of 60° C. and bismuth trichloride was added thereto to prepare a homogeneous solution, and this solution was cooled to 25° C. Then stannous chloride and aqueous ammonia were added to the solution, which in turn was again heated to the plating temperature to be employed for plating.

The plating solution was introduced into a plating vessel which was formed by a beaker of 500 ml in content volume, and controlled to a prescribed temperature ±1° C. Plating was performed with dripping of aqueous ammonia, and the pH value of the plating solution was controlled to a prescribed value ±0.05.

The plating solution was stirred by a magnetic stirrer.

On the other hand, an alloy plating solution was also formed by adding various metal chlorides shown in Table 2 to the basic bath shown in Table 1. In consideration of stability of the plating solution, the concentration values of the metal chlorides were set at the upper limits capable of maintaining bath stability in plating. Plating conditions for the alloy plating were identical to those shown in Table 1.

TABLE 2

| Metal Chloride | Concentration (M) |
|---|---|
| $AgNO_3$ | 0.008 |
| $PdCl_2$ | 0.008 |
| $CuCl_2.2H_2O$ | 0.02 |
| $SbCl_3$ | 0.02 |
| $NiCl_2.6H_2O$ | 0.04 |
| $NaAsO_2$ | 0.02 |
| $PbCl_2$ | 0.04 |

A 96% alumina ceramic substrate of 0.35 mm in thickness and a polyimide film (by Du Pont-Toray Co., Ltd.) of 50 μm in thickness were respectively employed as targets, which were subjected to alkaline degreasing/cleaning, thereafter activated by two-part treatment ($SnCl_2$ sensitization and $PdCl_2$ activation), subjected to repetitive activation twice, and then subjected to electroless plating. In the plating, the amount of introduction of each target was so decided that the ratio of the volume ($cm^3$) of the plating bath to the surface area ($cm^2$) of the target was 5.

1.2 Film Deposition Rate

The alumina substrate was taken out from the plating solution every 30 minutes, and the deposition rate of the film was calculated from changes in weight of the substrate. The weight was measured by a precision balance (AE240 by Mettler-Toledo Pac Rim Limited).

1.3 Structural Analysis of Deposition Film

The film deposited on the polyimide film was structurally analyzed with an X-ray diffractometer, while a surface and a broken-out section of the film deposited on the alumina substrate were observed with a scanning electron microscope.

2. Result and Consideration 2.1 Influence Exerted on Deposition Rate by Bath Component Concentration FIG. 1 illustrates changes of the deposition rate which were caused when concentration values of the complexing agents prepared from citrate and NTA contained in the basic bath were changed to perform plating. As to EDTA, plating was enabled only under the condition of the basic bath concentration in this experiment, since the plating bath was extremely decomposed when the content of EDTA was too small while deposition was stopped when the EDTA content was too large. Therefore, no detailed study was made as to the content of EDTA.

As to the citrate, uneven plating was easily caused when its concentration was not more than 0.20M, while a symptom of bath decomposition was recognized and fine powder of bismuth was generated when the concentration exceeded 0.5M. While deposition of a bismuth film was observed in a citrate concentration range of 0.20 to 0.5M, the optimum concentration of citrate was conceivably 0.34M, at which the film deposition rate was maximized.

On the other hand, a bath containing no NTA exhibited a suspended state in pale white, substantially with no film deposition. Deposition of a film was started when the NTA concentration reached 0.03M and the deposition rate was increased in proportion to the NTA content, while the plating bath was so extremely stabilized that it was difficult to attain further film deposition when the NTA concentration exceeded 0.30M. From the result of the above observation, it was conceived that preferable concentration of NTA is 0.20M.

2.1.2 Concentration of Reducing Agent

Figure 2:
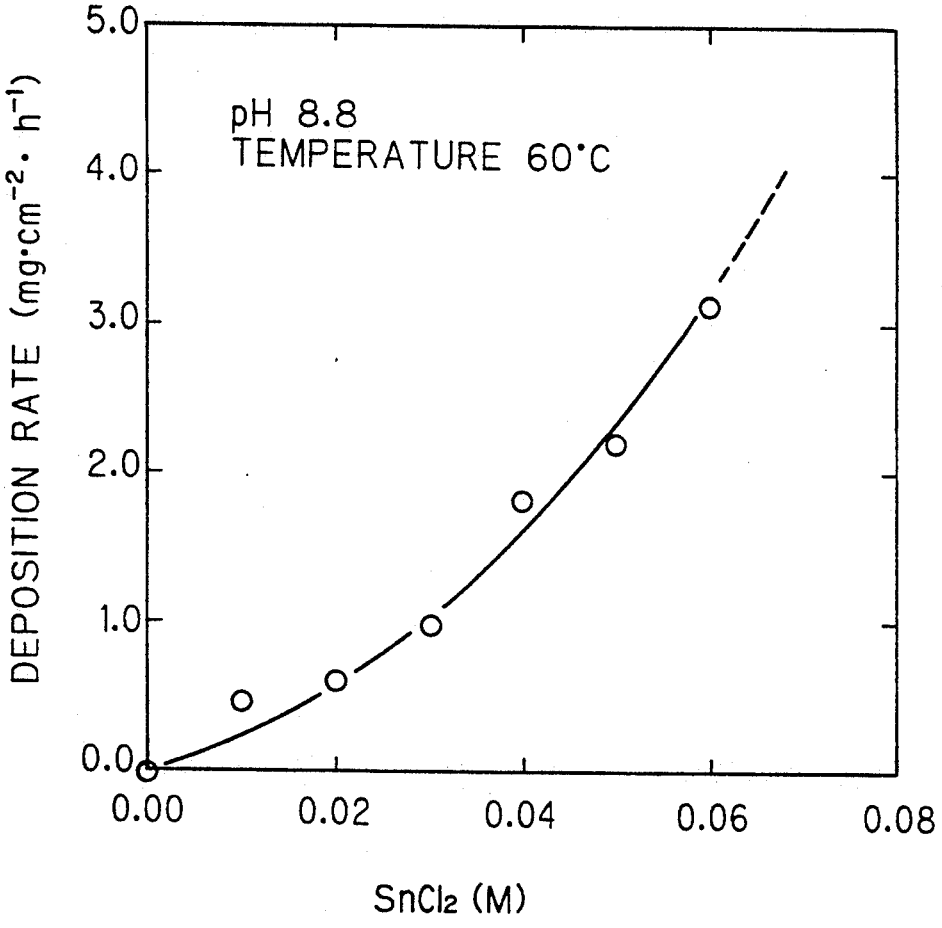
FIG. 2 illustrates an influence exerted on the deposition rate by concentration of $SnCl_2$.

FIG. 2 shows change of the plating deposition rate caused by change in concentration of stannous chloride serving as a reducing agent. While uneven plating was caused when the concentration of stannous chloride was not more than 0.03M, deposition of a homogeneous film was enabled with increase of the concentration and the deposition rate was also increased. When the concentration of stannous chloride was increased up to 0.08M, i.e., twice that in the basic bath, however, bath decomposition was started and adhesion of fine powder was observed on the substrate.

2.1.3 Bath Component Concentration

Figure 3:
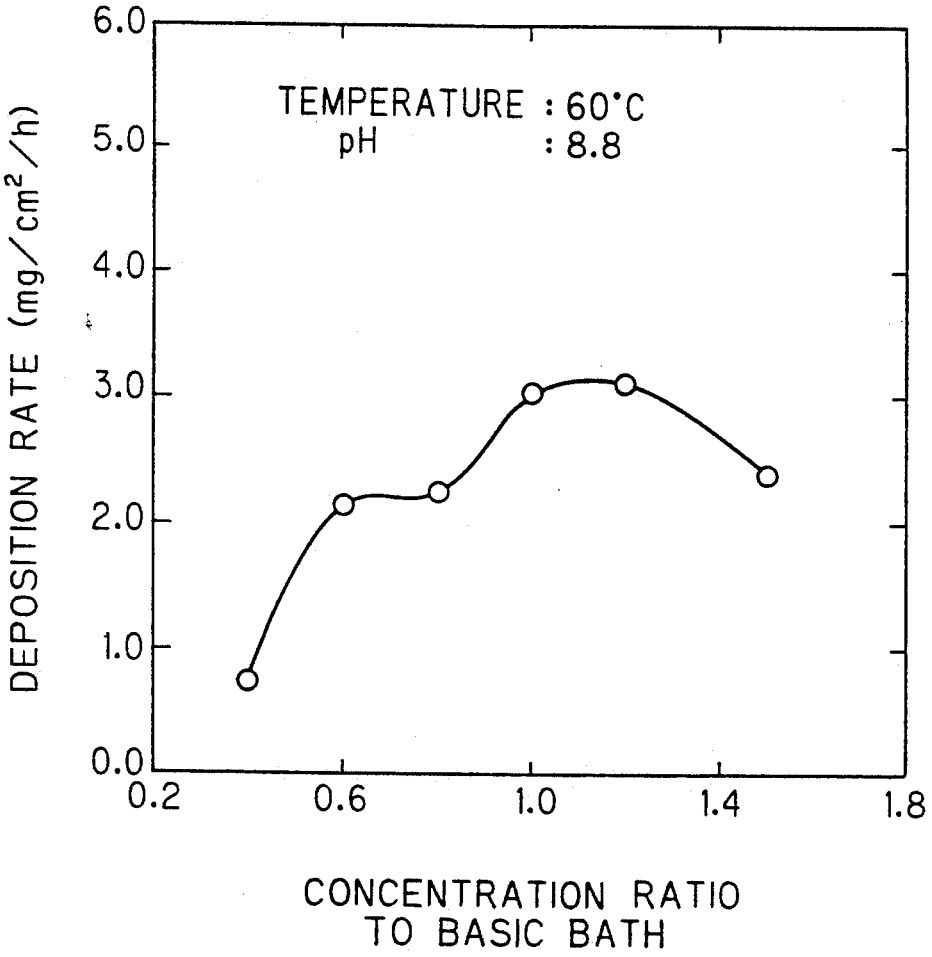
FIG. 3 illustrates an influence exerted on the deposition rate by concentration of bath components.

FIG. 3 shows change of the film deposition rate which were caused when the bath component concentration was changed with no change in component ratio of the basic bath composition. The deposition rate, which was slow when the bath component concentration was lower than the basic bath concentration, was increased as the concentration was increased, and the maximum deposition rate was observed when the bath component concentration was 1.2 times that of the basic bath. When the concentration exceeded this level, however, a trend of bath decomposition was observed and the amount of the deposit was reduced.

2.2 Influence Exerted on Deposition Rate by Plating Condition

Figure 4:
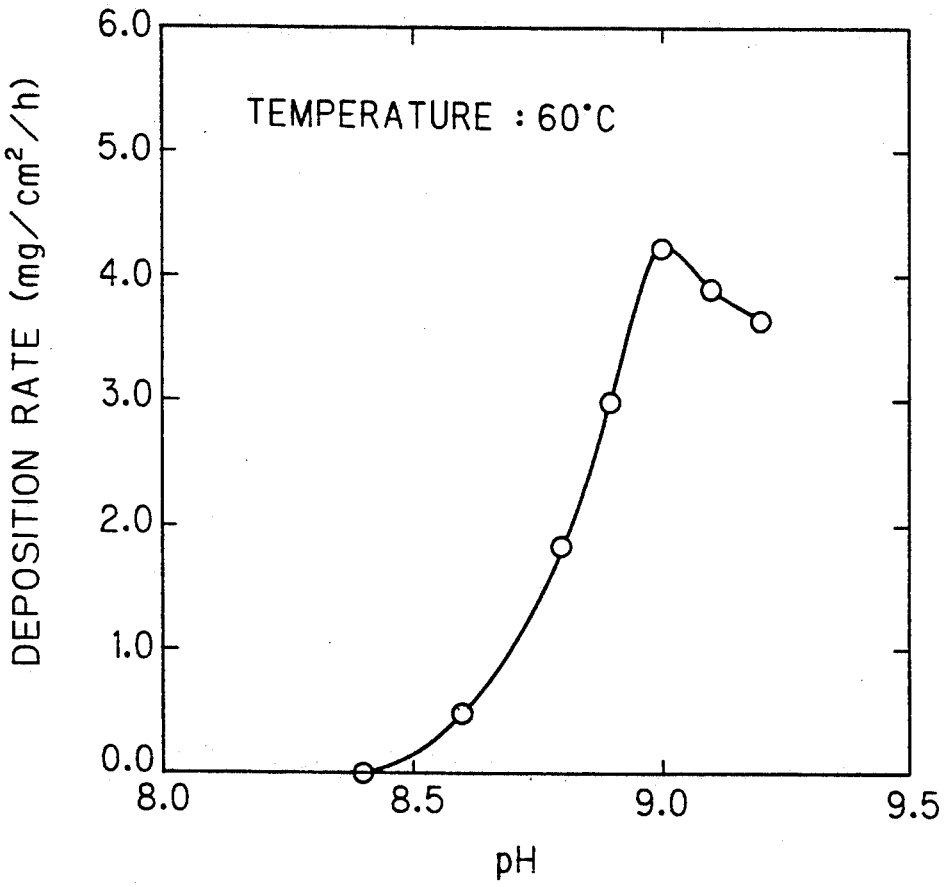
FIG. 4 illustrates an influence exerted on the deposition rate by the pH value.
Figure 5:
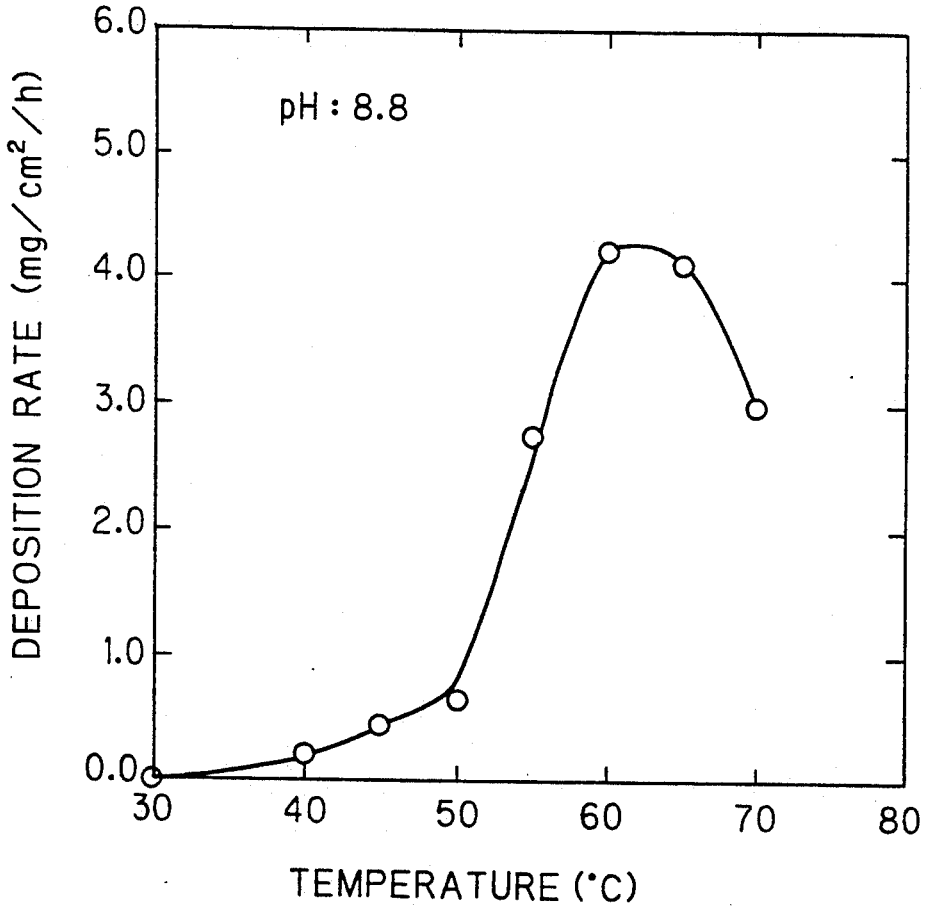
FIG. 5 illustrates an influence exerted on the deposition rate by the temperature.

In order to clarify influences exerted on the film deposition rate by the pH value and the temperature of the plating bath, plating was performed while changing the pH value and the bath temperature in ranges of 8.0 to 9.5 and 30° to 70° C. respectively, to obtain results shown in FIGS. 4 and 5. Deposition of a bismuth film was started when the pH value was 8.4, and the deposition rate was abruptly increased with increase of the pH value. When the pH value exceeded 9.0, however, bath decomposition was started and generation of bismuth fine powder was recognized. On the other hand, deposition of a plating film was enabled when the bath temperature exceeded 40° C., and the deposition rate was extremely increased with increase of the temperature. The maximum deposition rate was recognized at a temperature of 60° C., while decomposition of the plating bath was started and the amount of the deposit was reduced when the temperature exceeded this value. From the results of such observation, it was conceived that a preferable range of the pH value is 8.6 to 8.8, and a preferable plating temperature is 60° C.

2.3 Structure of Deposition Film and Eutectoid Element

Figure 6:
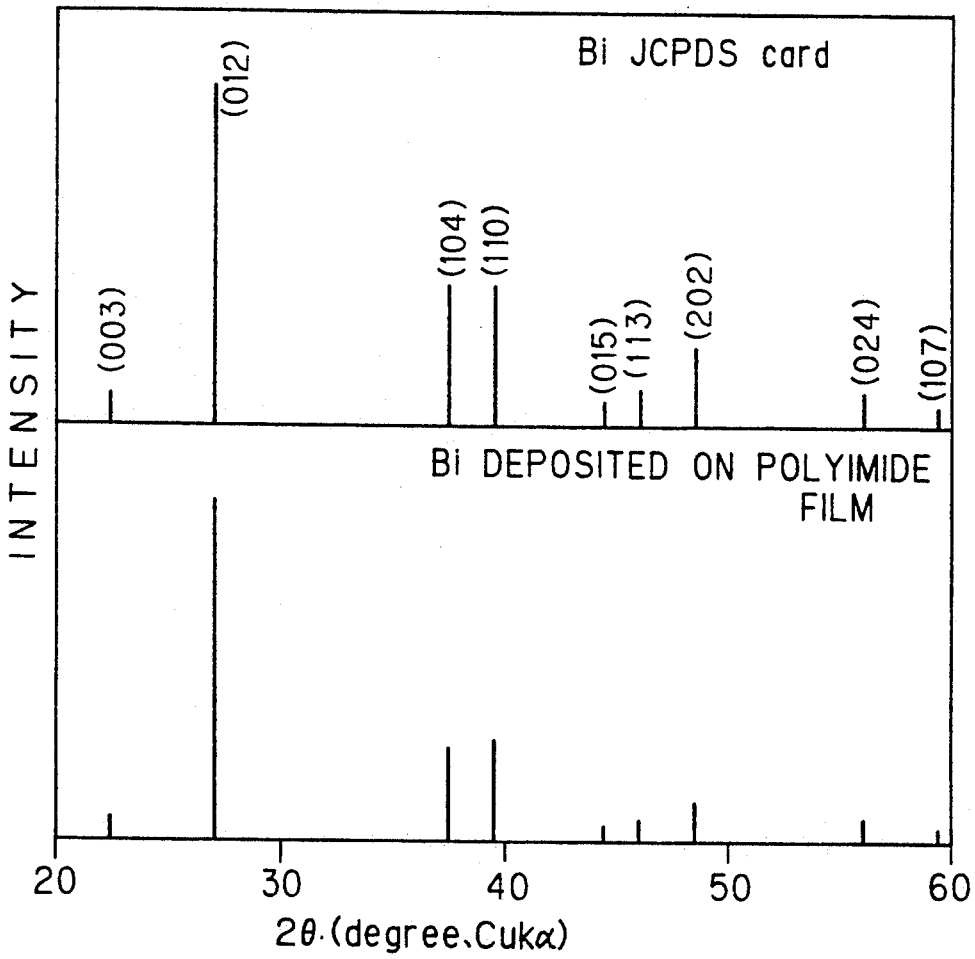
FIG. 6 illustrates an X-ray diffraction pattern of an electroless bismuth plating film.

FIG. 6 shows a result of X-ray diffraction of a film which was deposited on a polyimide film under the basic bath conditions. From contrast of the result of X-ray diffraction with a JCPDS card, it was clearly understood that the as-formed film was a bismuth film exhibiting no preferential orientation property. When this film was subjected to elementary analysis with an energy dispersive electron beam microanalyzer (EMAX) for confirmation of the eutectoid metal, no metal was detected in the film but bismuth. Thus, it was confirmed that the stannous ion which is added as a reducing agent itself forms no alloy film by disproportionation or eutectoid reaction with bismuth in electroless deposition of bismuth with a reducing agent of stannous chloride.

2.4 Amount of Deposit and Plating Time

Figure 7:
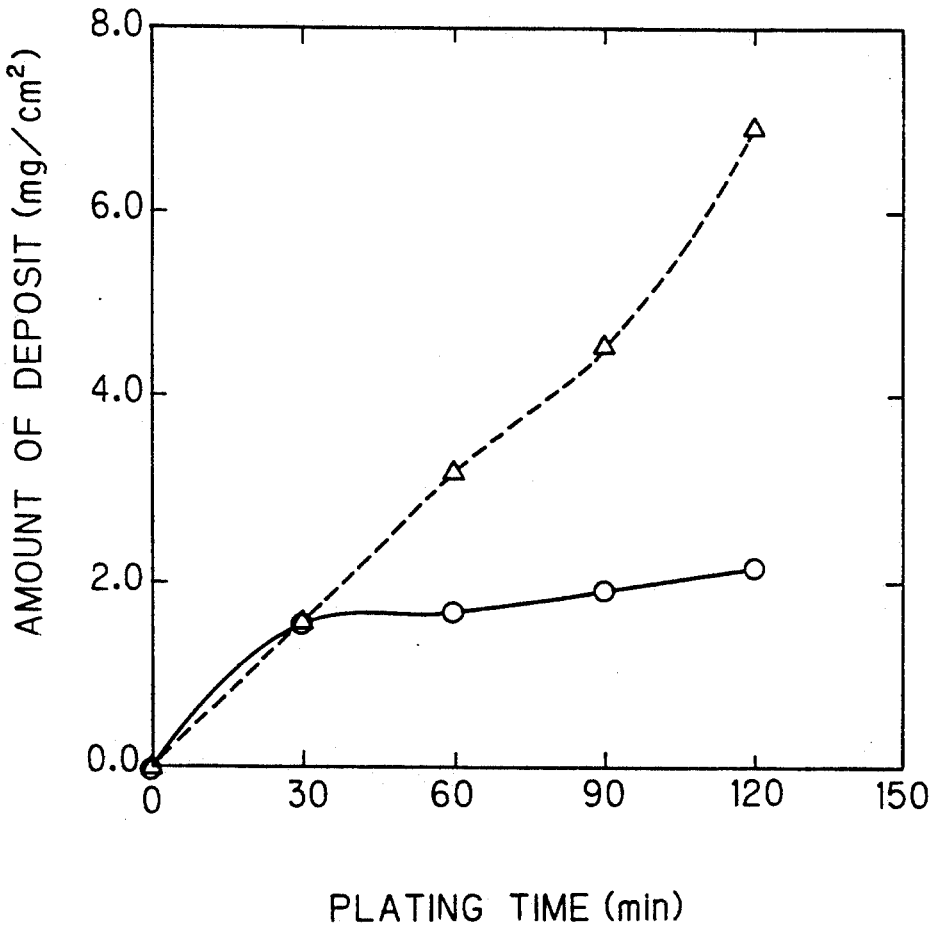
FIG. 7 illustrates an influence exerted on the amount of a deposit by the plating time.

FIG. 7 shows relation between the amount of film deposition and the plating time. When plating was continuously performed under the basic bath conditions in the same plating bath for 120 minutes, the amount of film deposition reached a constant value after 30 minutes and plating deposition was stopped, as shown by a solid line in FIG. 7. When plating was performed with renewal of the bath liquid every 30 minutes, on the other hand, the amount of the deposit was increased with the lapse of the plating time, as shown by a broken line in FIG. 7. This suggests that growth of the film progresses by autocatalytic reaction of the deposition film serving as a catalyst. This also shows that thick electroless plating of bismuth is enabled through the autocatalytic property of the as-deposited bismuth film.

2.5 SEM Observation of Surface and Broken-Out Section of Film

A surface and a broken-out section of a film which was plating-deposited on an alumina substrate with renewal of the bath liquid every 30 minutes were observed through SEM images. The surface of the film exhibited the same SEM image with no regard to the thickness of plating, while it was observed that the film was a porous bismuth film, which was made of particles of 0.2 to 0.3 μm, homogeneously deposited on the surface of the substrate. On the other hand, the SEM image of the broken-out section of this film exhibited that the film thickness was increased in proportion to the plating time, and that no change was caused in the shape of the broken-out section of the deposition film also when the plating was performed with renewal of the plating bath.

2.6 Selection of Reducing Agent

Progress of electroless plating is regarded as possible when the reversible potential of the deposition metal is "nobler" than the oxidation-reduction potential of the reducing agent. When titanium trichloride was employed as a reducing agent satisfying such a condition to perform electroless bismuth plating in advance of this experiment, the bath was so extremely decomposed that it was impossible to form a bismuth film.

Assuming that such bath decomposition was caused by the remarkable difference in oxidation-reduction potential between bismuth and titanium trichloride, it may conceivably be preferable to employ a reducing agent such as stannous chloride, for example, which is only slightly different in oxidation-reduction potential from bismuth in order to implement electroless deposition of bismuth and film deposition may be enabled in this case. Stannous chloride has the following "base" oxidation-reduction potential:

$$E^o\,(V)=0.844-0.1773\ pH\ (vs.\ N.\ H.\ E.)$$

as clearly understood from the following Pourbaix formula:

$$Sn^{2+}+3H_2O \rightarrow SnO_3^{2-}+6H^++e^-$$

Assuming that deposition of bismuth is expressed as follows, on the other hand, $$BiO^++2H^++3e^- \rightarrow Bi+2H_2O$$

bismuth has the following reversible potential:

$$E^o\,(V)=0.314-0.0394\ pH+0.0194\ \log\,(BiO^+)\ (vs.\ N.\ H.\ E.)$$

Namely, bismuth exhibits a value which is "nobler" than the oxidation-reduction potential of stannous chloride at the same pH value. Thus, it is inferable that the deposition of the bismuth film in this experiment was electroless plating with the stannous chloride serving as a reducing agent. In the electroless plating of this experiment, absolutely no generation of gaseous hydrogen was recognized in plating reaction. This suggests that electroless plating with stannous chloride serving as a reducing agent is different in behavior from ordinary plating reaction with a reducing agent which is prepared from formalin or sodium hypophosphite.

On the basis of the aforementioned fact that stannous chloride is applicable to a reducing agent, it is understood that such a reducing agent can be prepared not only from stannous chloride but from a bivalent water soluble compound of tin.

While the aforementioned concept was applied to selection of the reducing agent in this experiment, this concept is conceivably applicable also to selection of reducing agents for other electroless plating methods. It is conceivable that this concept is hereafter employed as a basic concept for selection of reducing agents.

3. Conclusion

Electroless plating of bismuth with a reducing agent of stannous chloride was studied to obtain the following recognition:

(1) Electroless bismuth plating, which had been regarded as impossible, was enabled through employment of stannous chloride ($SnCl_2$), which is used as a reducing agent for oxidation-reduction titration, as a reducing agent for electroless plating.

(2) The bismuth film was deposited on a non-conductor such as an alumina ceramic substrate or a polyimide film, and thick plating was also enabled by its autocatalytic reaction.

(3) A preferable plating bath composition was 0.08M of bismuth trichloride, 0.34M of sodium citrate, 0.08M of EDTA, 0.20M of NTA and 0.04M of stannous chloride, and preferable plating conditions were a plating temperature of 60° C. and a pH value of 8.6 to 8.8.

(4) The deposition film was made of bismuth exhibiting no preferential orientation property, and no eutectoid of another metal was recognized in this film.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electroless bismuth plating bath, comprising a trivalent salt of bismuth, a reducing agent, the reducing agent comprising a bivalent water soluble compound of tin, and complexing agent.

2. An electroless bismuth plating bath in accordance with claim 1, wherein said trivalent salt of bismuth is bismuth trichloride.

3. An electroless bismuth plating bath in accordance with claim 1, wherein said bivalent water soluble compound of tin is stannous chloride.

4. An electroless bismuth plating bath in accordance with claim 3, wherein said stannous chloride is present in said plating bath in an amount in excess of 0.03M and less than 0.08M.

5. An electroless bismuth plating bath in accordance with claim 1, wherein said complexing agent comprises sodium citrate, ethylenediaminetetraacetic acid and nitrilotriacetic acid.

6. An electroless bismuth plating bath in accordance with claim 5, wherein said sodium citrate is present in said plating bath in an amount in excess of 0.20M and less than 0.5M.

7. An electroless bismuth plating bath in accordance with claim 5, wherein said ethylenediaminetetraacetic acid is present in said plating bath in an amount of about 0.08M.

8. An electroless bismuth plating bath in accordance with claim 5, wherein said nitrilotriacetic acid is present in said plating bath in an amount of at least 0.03M and less than 0.30M.

9. An electroless bismuth plating bath in accordance with claim 1, comprising 0.08M of bismuth trichloride as said trivalent salt of bismuth, 0.04M of stannous chloride as said bivalent water soluble compound of tin, and 0.34M of sodium citrate, 0.08M of ethylenediaminetetraacetic acid and 0.20M of nirilotriacetic acid as said complexing agent.

10. An electroless bismuth plating bath in accordance with claim 1, wherein said bath has a pH of at least 8.4 and less than 9.0.

11. An electroless bismuth plating bath in accordance with claim 9, wherein said pH is between 8.6 to 8.8.

* * * * *